US009051783B2

(12) United States Patent
Croatto

(10) Patent No.: US 9,051,783 B2
(45) Date of Patent: Jun. 9, 2015

(54) VESSEL FOR OPERATING ON UNDERWATER WELLS AND WORKING METHODS OF SAID VESSEL

(75) Inventor: Paolo Croatto, Tarcento (IT)

(73) Assignee: SAIPEM S.p.A., San Donato Milanese (IT)

( * ) Notice: Subject to any disclaimer, the term of this patent is extended or adjusted under 35 U.S.C. 154(b) by 309 days.

(21) Appl. No.: 13/129,790

(22) PCT Filed: Nov. 17, 2009

(86) PCT No.: PCT/EP2009/065319

§ 371 (c)(1), (2), (4) Date: Sep. 13, 2011

(87) PCT Pub. No.: WO2010/055172

PCT Pub. Date: May 20, 2010

(65) Prior Publication Data

US 2012/0018166 A1 Jan. 26, 2012

(30) Foreign Application Priority Data

Nov. 17, 2008 (EP) ..... 08425732

(51) Int. Cl.

| | |
|---|---|
| ***E21B 19/09*** | (2006.01) |
| ***E21B 7/128*** | (2006.01) |
| ***E21B 41/10*** | (2006.01) |
| ***E21B 19/00*** | (2006.01) |

(52) U.S. Cl.

CPC ..... *E21B 19/006* (2013.01); *E21B 19/002* (2013.01)

(58) Field of Classification Search

CPC ..... E21B 19/006

USPC ..... 166/351, 352, 355, 367, 77.1, 85.1, 166/75.14; 405/196, 224.2, 224.4

See application file for complete search history.

(56) References Cited

U.S. PATENT DOCUMENTS

| | | | | |
|---|---|---|---|---|
| 1,541,986 | A * | 6/1925 | Martin | 294/91 |
| 2,684,166 | A * | 7/1954 | De Jarnett | 414/626 |

(Continued)

FOREIGN PATENT DOCUMENTS

| | | |
|---|---|---|
| GB | 2 023 205 | 12/1979 |
| GB | 2 085 051 | 4/1982 |

(Continued)

OTHER PUBLICATIONS

International Search Report and Written Opinion for International Appl. No. PCT/EP2009/065319, European Patent Office, The Netherlands, mailed on Oct. 14, 2010, 15 pages.

*Primary Examiner* — Matthew Buck
*Assistant Examiner* — Edwin Toledo-Duran
(74) *Attorney, Agent, or Firm* — Sterne, Kessler, Goldstein & Fox P.L.L.C.

(57) ABSTRACT

A vessel for operating on underwater wells has a deck; a moon pool extending through the deck; a further deck elevated above the moon pool and having a hole; and a compensation unit, which is mounted on the deck above the moon pool, is arranged between the deck and the further deck, and is provided with a frame sliding along the deck, a support carrier moveable with respect to the frame in a direction substantially vertical and suitable to support items, and a driving assembly connecting the support carrier to the frame and suitable to be selectively set so as to displace in the direction the support carrier either in a heave compensation mode or in a elevator mode.

25 Claims, 5 Drawing Sheets

(56) References Cited

U.S. PATENT DOCUMENTS

| | | | | | |
|---|---|---|---|---|---|
| 3,421,581 | A * | 1/1969 | Van Geijn | 166/355 |
| RE27,261 | E * | 12/1971 | Bromel | 114/264 |
| 3,718,266 | A * | 2/1973 | Donnally | 414/22.71 |
| 3,722,603 | A * | 3/1973 | Brown | 173/159 |
| 3,785,445 | A * | 1/1974 | Scozzafava | 175/5 |
| 3,834,672 | A * | 9/1974 | Hawley et al. | 254/392 |
| 3,943,868 | A * | 3/1976 | Person et al. | 114/264 |
| 3,981,369 | A * | 9/1976 | Bokenkamp | 175/5 |
| 4,039,177 | A * | 8/1977 | Person et al. | 267/126 |
| 4,108,318 | A * | 8/1978 | Rode et al. | 414/22.51 |
| 4,176,722 | A * | 12/1979 | Wetmore et al. | 175/7 |
| 4,200,054 | A * | 4/1980 | Elliston | 114/264 |
| 4,281,716 | A * | 8/1981 | Hall | 166/339 |
| 4,401,398 | A * | 8/1983 | Remson | 405/201 |
| 4,470,721 | A * | 9/1984 | Shotbolt | 405/224.4 |
| 4,576,516 | A * | 3/1986 | Denison | 405/224.4 |
| 4,616,707 | A * | 10/1986 | Langner | 166/345 |
| 4,617,998 | A * | 10/1986 | Langner | 166/345 |
| 4,646,672 | A * | 3/1987 | Bennett et al. | 114/264 |
| 4,673,041 | A * | 6/1987 | Turner et al. | 166/340 |
| 4,694,909 | A * | 9/1987 | Stephenson et al. | 166/356 |
| 4,808,035 | A * | 2/1989 | Stanton et al. | 405/224.4 |
| 4,890,671 | A * | 1/1990 | Baxter | 166/250.01 |
| 4,913,238 | A * | 4/1990 | Danazcko et al. | 405/223.1 |
| 4,934,870 | A * | 6/1990 | Petty et al. | 405/199 |
| 4,962,817 | A * | 10/1990 | Jones et al. | 175/5 |
| 5,147,148 | A * | 9/1992 | White et al. | 405/199 |
| 6,000,480 | A * | 12/1999 | Eik | 175/8 |
| 6,068,066 | A * | 5/2000 | Byrt et al. | 173/4 |
| 6,343,662 | B2 * | 2/2002 | Byrt et al. | 173/4 |
| 6,343,893 | B1 * | 2/2002 | Gleditsch | 405/196 |
| 6,347,912 | B1 * | 2/2002 | Thomas | 405/224.2 |
| 6,386,290 | B1 * | 5/2002 | Headworth | 166/346 |
| 6,431,285 | B2 * | 8/2002 | Hopper et al. | 166/368 |
| 6,470,969 | B1 * | 10/2002 | Sorhaug et al. | 166/355 |
| 6,499,418 | B1 * | 12/2002 | Pollack | 114/265 |
| 6,601,656 | B2 * | 8/2003 | Hopper et al. | 175/5 |
| 6,691,775 | B2 * | 2/2004 | Headworth | 166/77.2 |
| 6,691,784 | B1 * | 2/2004 | Wanvik | 166/355 |
| 6,708,765 | B1 * | 3/2004 | Eilertsen | 166/350 |
| 6,718,899 | B2 * | 4/2004 | Pollack | 114/230.1 |
| 6,745,840 | B2 * | 6/2004 | Headworth | 166/346 |
| 6,752,213 | B1 * | 6/2004 | van der Poel | 166/355 |
| 6,766,860 | B2 * | 7/2004 | Archibald et al. | 166/341 |
| 6,834,723 | B2 * | 12/2004 | Jordan | 166/355 |
| 6,834,724 | B2 * | 12/2004 | Headworth | 166/384 |
| 6,929,071 | B2 * | 8/2005 | Moncus et al. | 166/355 |
| 7,163,061 | B2 * | 1/2007 | Moncus et al. | 166/355 |
| 7,188,677 | B2 * | 3/2007 | Moe | 166/355 |
| 7,191,837 | B2 * | 3/2007 | Coles | 166/355 |
| 7,219,739 | B2 * | 5/2007 | Robichaux | 166/355 |
| 7,231,981 | B2 * | 6/2007 | Moe et al. | 166/355 |
| 7,306,404 | B2 * | 12/2007 | Torgersen | 405/224.4 |
| 7,314,087 | B2 * | 1/2008 | Robichaux | 166/355 |
| 7,404,443 | B2 * | 7/2008 | Patton et al. | 166/355 |
| 7,530,399 | B2 * | 5/2009 | Dreelan | 166/355 |
| 7,784,546 | B2 * | 8/2010 | Patton | 166/355 |
| 8,191,636 | B2 * | 6/2012 | Coles | 166/355 |
| 8,256,520 | B2 * | 9/2012 | Lucas et al. | 166/352 |
| 8,522,880 | B2 * | 9/2013 | Roodenburg et al. | 166/339 |
| 8,579,034 | B2 * | 11/2013 | Berner et al. | 166/355 |
| 8,607,898 | B2 * | 12/2013 | Rodgers | 175/113 |
| 8,613,322 | B2 * | 12/2013 | Coles | 166/355 |
| 2004/0134661 | A1 * | 7/2004 | von der Ohe | 166/367 |
| 2005/0129464 | A1 * | 6/2005 | Moncus et al. | 405/203 |
| 2006/0005962 | A1 * | 1/2006 | Juhasz et al. | 166/77.1 |
| 2006/0102356 | A1 * | 5/2006 | Torgersen | 166/355 |
| 2008/0251258 | A1 * | 10/2008 | Bamford | 166/355 |
| 2012/0132435 | A1 * | 5/2012 | Yemington | 166/355 |
| 2013/0195559 | A1 * | 8/2013 | Andresen et al. | 405/224.4 |
| 2014/0174753 | A1 * | 6/2014 | Kristensen et al. | 166/350 |

FOREIGN PATENT DOCUMENTS

| | | |
|---|---|---|
| GB | 2 175 946 | 12/1986 |
| GB | 2 354 028 | 3/2001 |
| GB | 2 431 420 | 4/2007 |
| WO | WO 2007108673 A1 * | 9/2007 |

* cited by examiner

VESSEL FOR OPERATING ON UNDERWATER WELLS AND WORKING METHODS OF SAID VESSEL

TECHNICAL FIELD

The present invention refers to a vessel for operating on underwater wells.

Wells and in particular underwater wells need many operations to be performed over time. Such operations include first drilling, re-drilling for workover purposes, and many other workover operations such as major maintenance or remedial treatments of the underwater wells.

Operations can be performed by means of a rig or a coil tubing frame and coiled tubing, snubbing or slickline equipment or a combination of a rig, and a coil tubing frame. In many cases, these operations include a number of activities to be executed aboard the vessel such as mounting valve assemblies to a tubular string or to a coil tubing; coil tubing operations; dismounting valve assemblies from a tubular string etc.

BACKGROUND ART

All these operations are rendered more complicated when the vessel is connected to a wellhead and is subjected to heave movement. When a tubular string connects the wellhead to the vessel, the heave movement of the vessel may stress the wellhead, the tubular string, and the equipment of the vessel connected to the tubular string. For this reasons it is known to compensate the heave movement of the vessel to minimize the above-identified stresses.

On this subject GB 2,343,466 A discloses a vessel including a main deck; and a compensation derrick mounted on the main deck. The derrick comprises a frame, a support carrier which is moveable in a direction substantially vertical with respect to the frame and is suitable to support a tubular string connected to a wellhead and a coil tubing injector, and a draw work that is connected to the support carrier and to a compensating assembly.

The vessel disclosed in GB 2,343,466 has the drawback of being dedicated to carry out coil tubing operations only and lacking flexibility.

On the contrary multi-purpose vessels operating on underwater wells need many activities to be done aboard the vessel. In particular, many heavy items are raised, positioned, lowered and assembled when suspended along the main deck.

It follows that the working conditions are rather dangerous for the operators involved in the above-identified activities aboard the vessel.

DISCLOSURE OF INVENTION

One of the objects of the present invention consists in making a vessel suitable to carry out various activities related to operations on underwater wells and, at the same time, increasing the safety aboard the vessel.

According to the present invention there is realized a vessel for operating on underwater wells; the vessel including a main deck; a moon pool extending through the main deck; a further deck elevated above the moon pool and having a hole; and a compensation unit, which is mounted on the main deck above the moon pool is arranged between the deck and the further deck, and comprises a frame, a support carrier moveable with respect to the frame in a direction substantially vertical and suitable to carry items, and a driving assembly that is connected to the support carrier and to the frame and is suitable to be selectively set so as to displace in said direction the support carrier with respect to the frame in a heave compensation mode, and in a elevator mode.

In this way the compensation unit is a multi-purpose compensation unit and is able to operate as an elevator when the support carrier is not connected to a wellhead by a tubular string.

In this way the multi-purpose compensation unit adapts the vessel to various different operations and increases the safety of the operators working aboard the vessel.

In a preferred embodiment of the present invention the compensation unit comprises at least a hydraulic linear actuator allowing a bigger compensation range with respect to the known compensation system.

Furthermore when the support carrier is connected to the top of a tubular string, the support carrier may support a coil tubing frame and there is no need of using a slip joint with corresponding sliding seals.

According to another preferred embodiment the invention refers to a vessel for operating on underwater wells; the vessel including a main deck; a moon pool extending through the main deck; a further deck elevated above the moon pool and having a hole; and a compensation unit, which is mounted on the main deck above the moon pool is arranged between the deck and the further deck, and comprises a frame, a support carrier moveable with respect to the frame in a direction substantially vertical and suitable to carry items, and a driving assembly that is connected to the support carrier and to the frame; wherein the compensation unit is slindingly coupled to the main deck so as to displace the support carrier along the main deck above the moon pool with respect to the further deck.

In this way the support carrier can be displaced above the moon pool even when a tubular string connects the wellhead to the support carrier and many additional operations can be easily performed aboard the vessel.

The present invention further relates to a working method of a vessel for operating on underwater wells.

According to the present invention there is provided a working method of a vessel for operating on underwater wells, wherein the vessel includes a main deck; a moon pool extending through the main deck; a further deck elevated above the moon pool and having a hole; and a compensation unit, which is mounted on the main deck above the moon pool is arranged between the deck and the further deck, and comprises a frame, a support carrier moveable with respect to the frame in a direction substantially vertical and suitable to carry items, and a driving assembly that is connected to the support carrier and to the frame; the method comprising the step of setting the driving assembly to selectively displace the support carrier with respect to the frame in said direction in a heave compensation mode or in a elevator mode.

BRIEF DESCRIPTION OF THE DRAWINGS

Further technical features and advantages of the invention will be disclosed by the following detailed description of a non-limiting embodiment with reference to the enclosed drawings, wherein.

BEST MODE FOR CARRYING OUT THE INVENTION

The detailed description refers to the best embodiment of the present invention.

The Vessel

Figure 1:
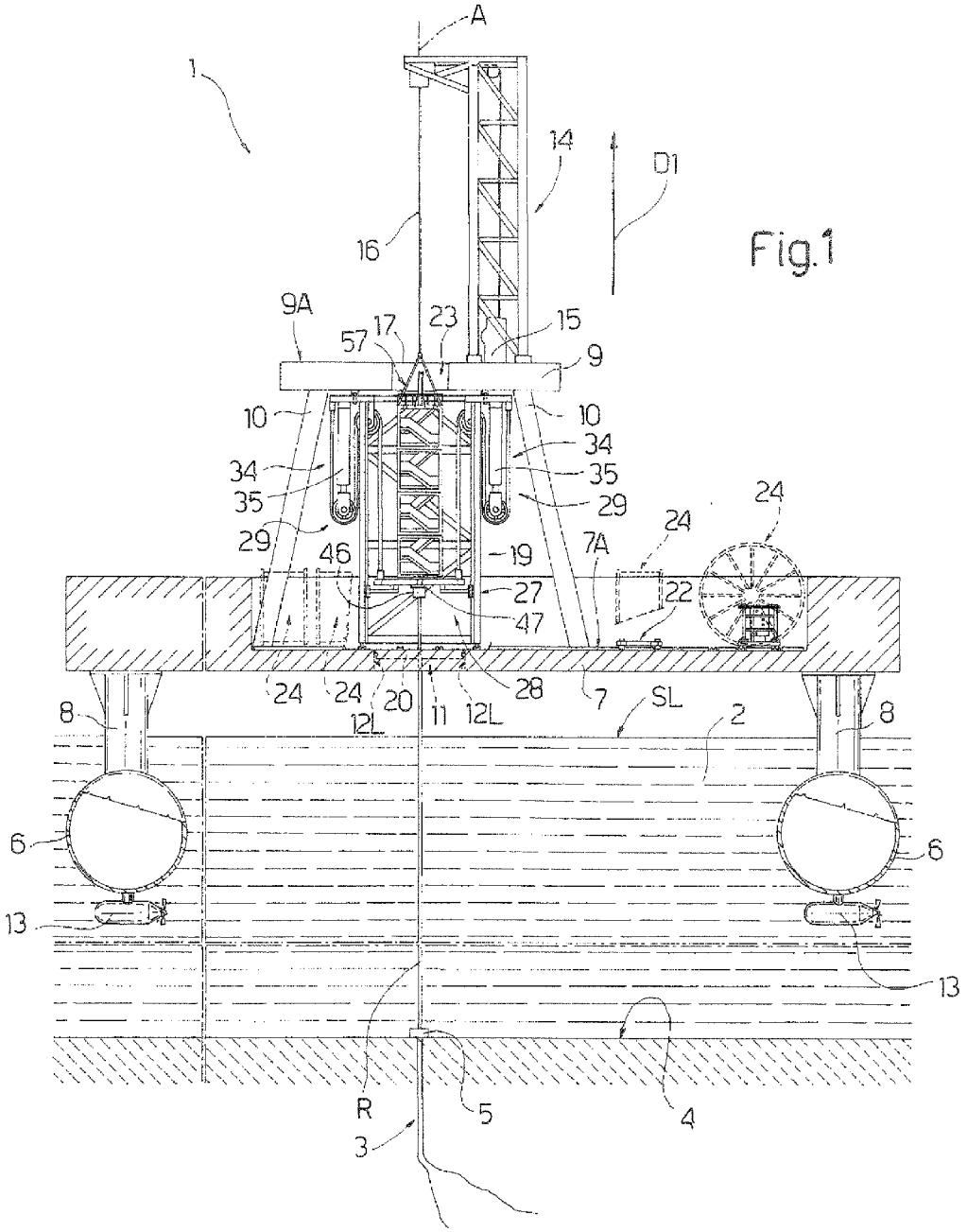
FIG. 1 is a side elevation view, with part removed for clarity and part in cross-section, of a vessel in accordance to the present invention.

In FIG. 1 reference numeral 1 indicates a vessel floating in a body of water 2 and operating on an underwater well 3 extending into the bed 4 of the body of water 2. The well 3 has a wellhead 5 that protrudes from the bed 4 and is connected to the vessel 1 by a tubular string R. For the purpose of the present invention, the definition tubular string encompasses any type of tubular assemblies either formed by riser or any other kind of tubular member used in the operations of the vessel.

In the example shown in the enclosed figures, the vessel 1 is a semisubmersible vessel comprising large pontoon-like structures 6 submerged below the sea level SL; a main deck 7 that is elevated above the pontoon-like structures 6 on large steel columns 8 and is provided with a starboard S1; a portside S2 (FIG. 2); and a drill deck 9 elevated above the main deck 7 on columns 10. The main deck 7 is provided with a moon pool 11 (a large opening into the main deck 7 allowing the passage of drilling equipment). As better shown in FIG. 2, the moon pool 11 is delimited by a rim having a rectangular shape, and comprising two longitudinal sides 12L, and two transversal sides 12S, namely a starboard transversal side 12S and a portside transversal side 12S.

In the following description with the definition deck is defined a structure, whereas with the term surface is defined the upper face of the same structure. As a consequence the main deck 7 is provided with a main surface 7A, and the drill deck 9 is provided with a drill surface 9A. Further, for the purpose of the present invention the definition main deck encompasses any deck suitable to store on it a large number of items. For the purpose of the present invention with the definition drill deck is intended any deck elevated from a lower deck and supporting a crane.

The semisubmersible vessel 1 has the advantage of submerging the pontoon-like structures 6 and minimizing loading from waves and wind. For this reasons the semisubmersible vessel 1 can operate in a wide range of water depths, including deep water. Station keeping of the semisubmersible vessel 1 can be achieved either by using a number of anchors tethered by strong chains and computer-controlled wire cables or by computer-controlled thrusters indicated with number 13 in the embodiment shown in FIG. 1.

Vessel 1 farther comprises equipment for drilling and performing workover operations on the underwater well 3.

Even though the description refers expressly to a semisubmersible vessel the present invention is not limited to semisubmersible vessel and includes any kind of vessel like, for example, single hull vessel.

The Equipment

With reference to FIG. 1, the drilling and workover equipment comprises a tower crane 14 mounted on the drill deck 9; and a draw work 15 that is mounted on the drill deck 9 and is connected to the top the of the tower crane 14 by a hauling cable 16 that defines the operating axis A of the tower crane 14. The operating axis A is vertical or substantially vertical because of the movement of the vessel 1. The drill deck 9 includes a removable panel 17 located above the moon pool 11 and a hole 18 (FIG. 3) that is arranged in the removable panel 17 and extends about the operating axis A.

The tower crane 14 can be any kind of tower crane such as a derrick, a ram crane, in turn equipped with top drive etc. The drill deck 9 may be equipped as well with a rotary table extending about hole 18 and any other kind of drilling equipments and devices for handling tubular members for making tubular strings R on the drill deck 9.

The draw work 15 may be advantageously connected to a compensation assembly of known type and not shown in the enclosed figures.

The equipment further comprises a compensation unit 19 mounted on the main deck 7; a dolly 20 supported by the main deck 7 and moving along the moon pool 11; a rail assembly 21 (FIG. 2) extending on the main deck 7 and on the dolly 20; transport carriages 22 running along the rail assembly 21; and a coil tubing frame 23 that in FIG. 1 is shown on the compensation unit 19.

A number of valve assemblies like a blowout preventer 25 and a christmas tree 26 arranged on respective carriages 22, and a number of reels 24 of coiled tubing are stored on the main deck 7.

The Compensation Unit

Figure 2:
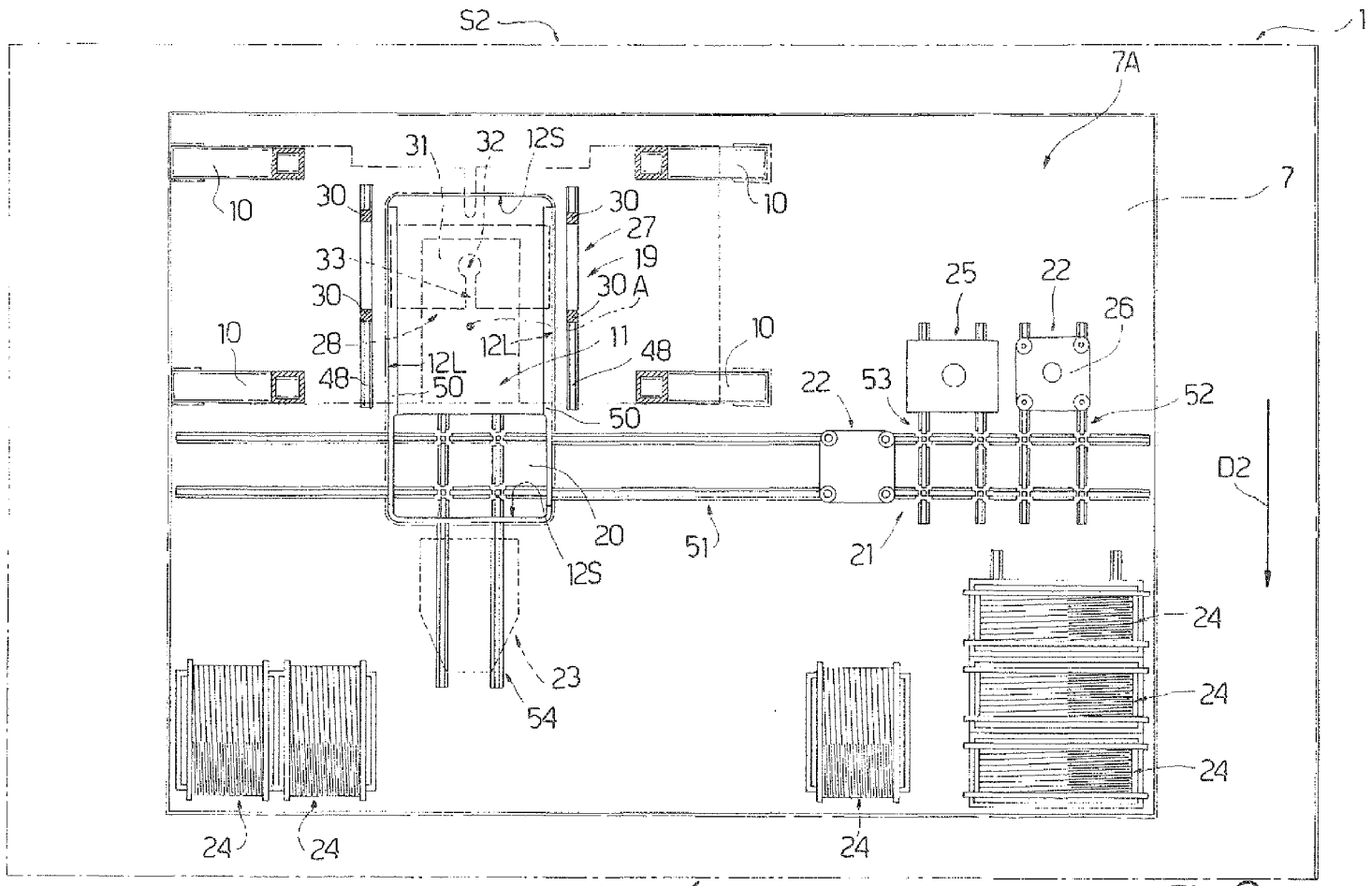
FIG. 2 is a plan view, with parts removed for clarity, of the main deck of the vessel of FIG. 1.
Figure 3:
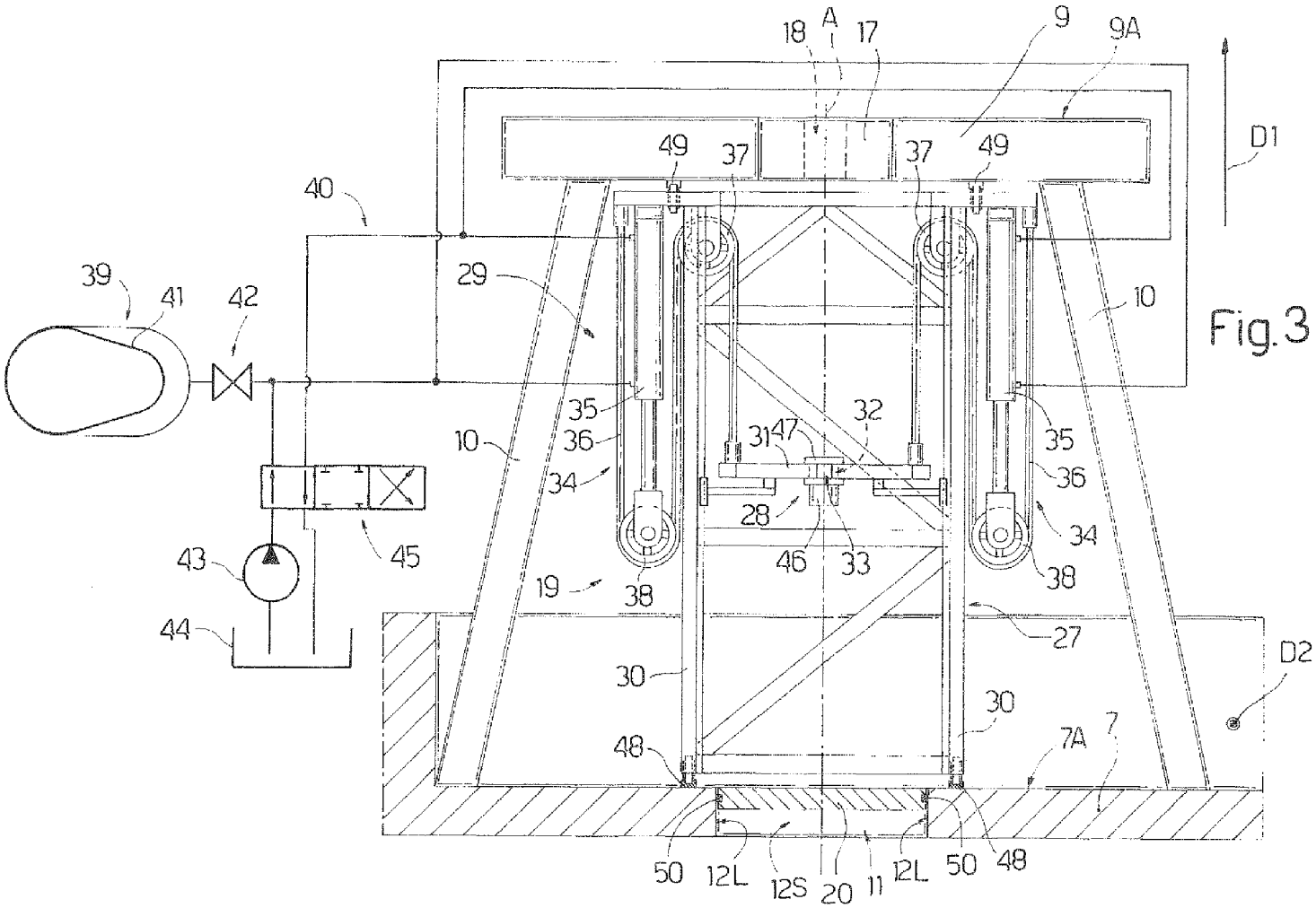
FIG. 3 is a side elevation view, in an enlarged scale with parts in cross-section, and parts schematically illustrated, of a detail of the vessel of FIG. 1.
Figure 4:
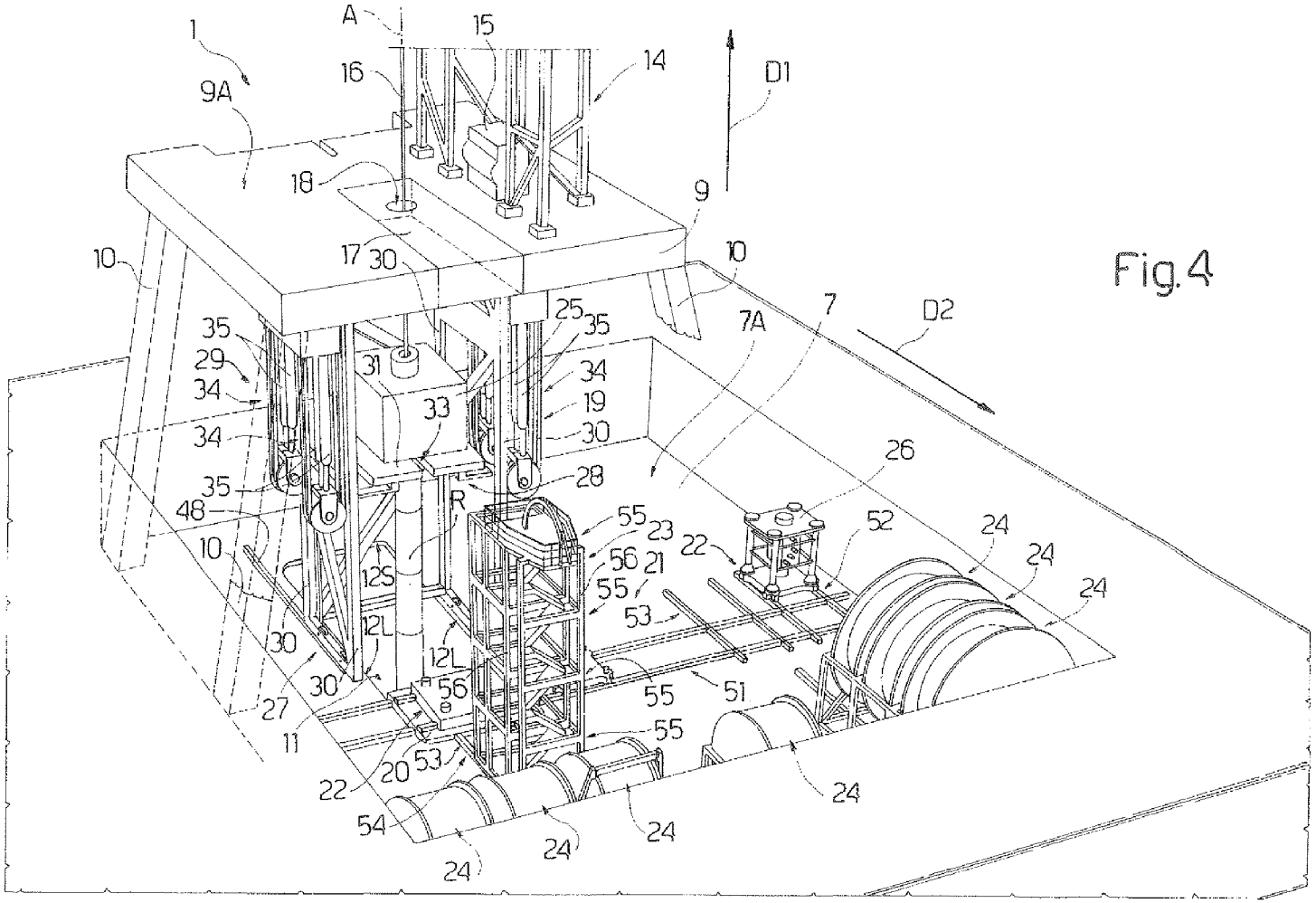
FIGS. 4 and 5 are axonometric views, with part removed for clarity, of the vessel of FIG. 1 in two respective working configurations.

With reference to FIG. 3, the compensation unit 19 is arranged above the moon pool 11, is slidingly coupled to the main deck 7 in a direction D2 parallel to the main deck 7, and is arranged between the main deck 7 and the drill deck 9. The sliding movement of the compensation unit 19 occurs between a rest position at the portside transversal side 12S (FIG. 2) and an operating position, wherein the compensation unit 19 is aligned to the operating axis A (FIG. 4). Advantageously the compensation unit 19 is in sliding engagement with the lower side of the drill deck 9.

The compensation unit 19 includes a frame 27; a support carrier 28; and a driving assembly 29 which is connected to the frame 27 and to the support carrier 28 and is suitable to operate the support carrier 28 in a heave compensation mode and in an elevator mode for raising and lowering items.

The frame 27 is tower-shaped and extends prevalently in the direction D1. The frame 27 has four uprights 30 arranged at the vertexes of a hypothetical rectangle (FIG. 2) and a number of beams connecting the uprights 30 along three sides only of the hypothetical rectangle in order to form a truss structure extending along three side, The frame 27 has an open side facing starboard S1 of the main deck 7 (FIG. 2).

The support carrier 28 is slidingly supported by the uprights 30 in the direction D1 parallel to the uprights 30 and comprises a plate 31. With reference to FIG. 2, the plate 31 has a rectangular outer edge, a central hole 32, and a slit 33 connecting the central hole 32 to the outer edge at the open side of the frame 27. In other words, the slit 33 extends from the central hole 32 toward starboard S1. In particular, the slit 33 is parallel to direction D2 and to the sliding movement of the compensation unit 19.

The plate 31 further comprises a spool of jumper hoses (not shown) so has to fluidically connect the jumper hoses to fixed lines (not shown) arranged along the main deck 7.

The driving assembly 29 comprises four driving mechanism 34 each arranged at a respective upright 30. Each driving mechanism 34 is substantially a lifting tackle operated by a hydraulic linear actuator 35 and comprises a rope 36 having one end fixed to the top of the frame 27 and the other end fixed to the support carrier 28; a pulley 37 fixed to the top of the frame 27 above the support carrier 28; and a pulley 38 fixed to the moving end of the hydraulic linear actuator 35 which is fixed to the top of the frame 27.

The driving assembly 29 further comprises a compensation reservoir 39 operating according to the principle of the constant load, and a hydraulic circuit 40 connecting the hydraulic linear actuators 35 to the compensation reservoir 39. In other words, the hydraulic linear actuators 35 are operated by a liquid, usually oil, which is in communication with the compensation reservoir 39 through the hydraulic circuit 40. The compensation reservoir 39 is provided with two compartments tightly divided by a moveable wall 41. The oil fills the hydraulic linear actuators 35 and one compartment, whereas a large volume of gas occupies the other compartment of the compensation reservoir 39. Since the volume of oil is negligible with respect to the volume of gas, the variations of pressure of the gas are negligible even when relatively large displacements of the moveable wall 41 occur. As a consequence, also the pressure of the oil is kept substantially constant and the load applied to the support carrier 28 is kept constant.

Once the support carrier 28 is connected to the wellhead 5 by the tubular string R as shown in FIG. 1, the load variation induced by the heave movement of the vessel 1 is transmitted from the wellhead 5 through the tubular string R to the plate 31 and to hydraulic linear actuators 35. As a consequence, any time a heave movement occurs, the driving assembly 29 allows the displacement of the support carrier 28 while keeping constant the load on the wellhead 5.

In addition to the heave compensation mode, the compensation unit 19 may operate in an elevator mode for raising and lowering items. For this purpose and with reference to FIG. 3, the hydraulic circuit 40 further includes a valve 42 for isolating the hydraulic linear actuators 35 from the compensation reservoir 39; a hydraulic pump 43; a tank 44, and a two way valve 45 having three operating positions for varying the length of the hydraulic linear actuators 35 and the height of the support carrier 28 with respect to the main deck 7 upon request.

In other words, an operator by actuating valves 42 and 45 may set the driving unit 29 in two operating modes: the compensation mode, and the elevator mode, In FIG. 1 the tubular string R is hanged to plate 31 by means of a spider 46 and a gimble 47. The spider 46 and the gimble 47 are well known mechanisms for gripping tubular strings, whereas the gimble 47 is a well know type of mechanism that is used for allowing swinging movement of the tubular string R with respect to the spider 46.

In this way, the compensation unit 19 may conveniently slides back and forth in direction D2 even when the tubular string R is hanged to the support carrier 28 and is connected to wellhead 5.

With reference to FIG. 2, the compensation unit 19 may slide on the main deck 7 from the rest position at the portside transversal side 12S of the moon pool 11 to an operating position at the centre of the moon pool 11 where the central hole 32 of plate 31 is aligned with axis A.

The main deck 7 is provided with tracks 48 arranged at opposite sides of the moon pool 11. In particular, each track 48 runs along the main deck 7 in close proximity of, and parallel to a respective longitudinal side 12L of the moon pool 11.

With reference to FIG. 3, the drill deck 9 supports a pair of tracks 49, which are arranged under the drill deck 9 and are parallel to track 48 for slidingly engaging the upper portion of the compensation unit 19.

The compensation unit 19 is further equipped with any suitable actuating mechanism (not shown) to displace the compensation unit 19 along the main deck 7 back and forth in the direction D2.

The Dolly

With reference to FIG. 2, the dolly 20 is a plate in sliding engagement with a pair of rails 50 running along the longitudinal sides 12L of the moon pool 11 in the direction D2. The dolly 20 is further equipped with any suitable actuator (not shown) to displace the dolly 20 along the moon pool 11 from a rest position shown in FIG. 2 and any other position along the moon pool 11. In its rest position the dolly 20 is in abutment against the starboard side 12S of the moon pool 11, whereas in a particular operating position the dolly 20 is in alignment to the operating axis A.

For example, a not shown actuating mechanism for the compensation unit 19 and for the dolly 20 may include a rack and pinion transmission and an electric motor connected to the pinion.

The dolly 20 has an operating upper surface flush with the main surface 7A. This condition allows transferring easily heavy and burdensome items from the main deck 7 to the dolly 20 simply by sliding them along the main surface 7A and the adjacent upper surface of the dolly 20.

The Rail Assembly

With reference to FIG. 2, the rail assembly 21 extends along the main deck 7 and along the dolly 20 and has the purpose of facilitating the handling of equipment, such as the coil tubing frame 23, the blowout preventer 25 and the christmas threes 26, stored on the main deck 7. The rail assembly 21 includes a number of straight lines 51, 52, 53, and 54 each made of a pair of parallel rails. Line 51 extends along the main deck 7 and along the dolly 20 (when the dolly 20 is arranged in the rest position) and is perpendicular to the direction of tracks 48 and 49 and rails 50.

Lines 52, 53 and 54 are parallel to D2, are arranged on the main deck 7, and are perpendicular to line 51, and cross line 51. In particular, line 54 extends partly on the dolly 20 and crosses line 51 on the dolly 20.

The rail assembly 21 is travelled by the transport carriages 22, and the coil tubing frame 23.

The displacement of the carriages 22 along the rail assembly 21 is actuated by means any suitable actuating mechanism such a rack and pinion transmission and an electric motor connected to the pinion (not shown in the enclosed figures).

The Coil Tubing Frame

Figure 5:
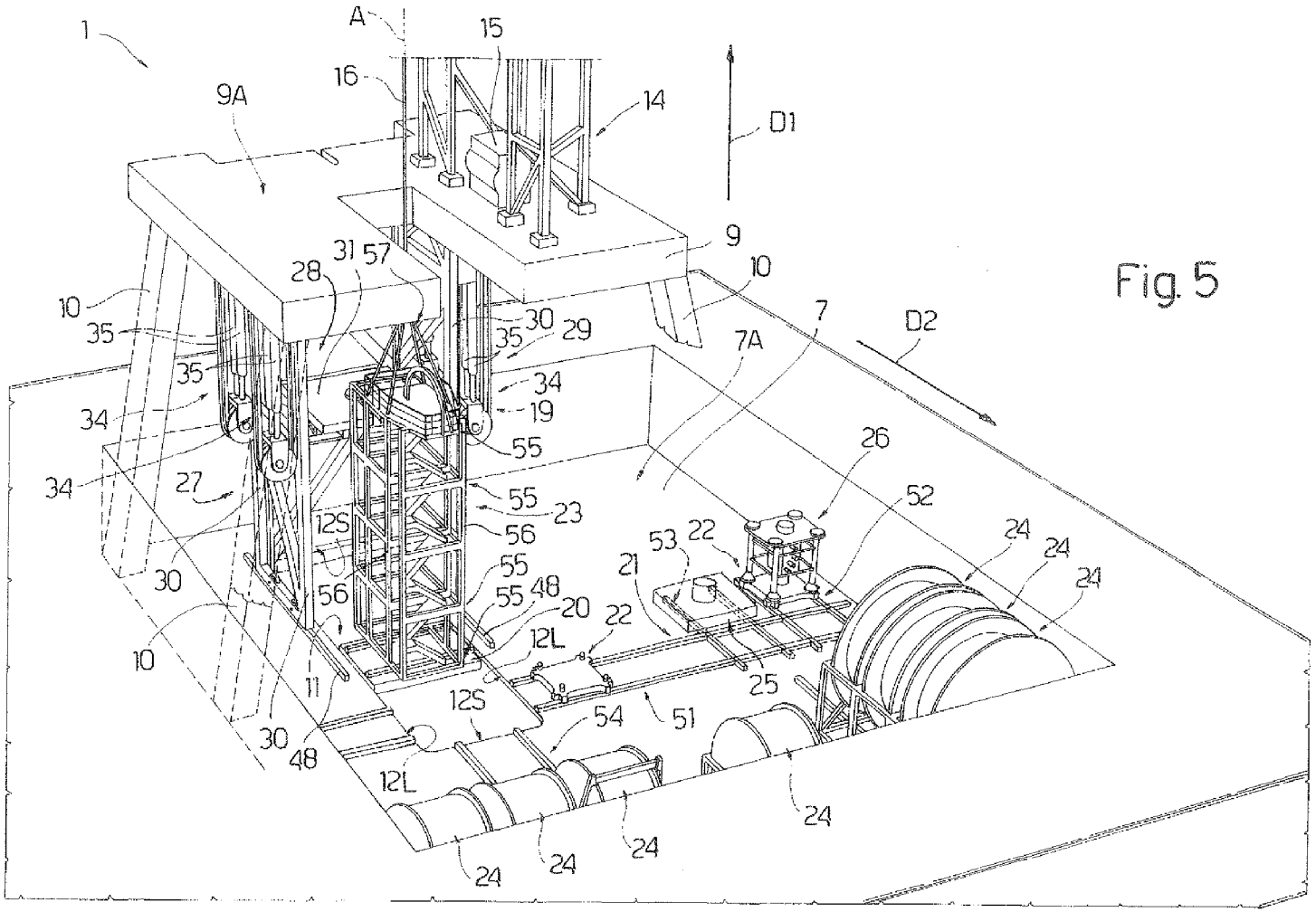

With reference to FIGS. 4 and 5, the coil tubing frame 23 extends prevalently in vertical direction and comprises a number of floors 55 arranged one above the others; uprights 56 connecting the floors 55; stairs permitting the operating personnel to reach the different floors 55; and banisters.

The coil tubing frame 23 is further equipped with valve assemblies for connecting the coil tubing to jumper hoses, a coil tubing injector, and several other equipment not shown in the enclosed drawings.

The lowest floor 55 is suitable to skid along the rail assembly 21 and to be locked in a given position on the support carrier 28. The coil tubing frame 23 can be suspended above the moon pool 11 by means of the tower crane 14 and a sling 57 as shown in FIG. 1.

The Working Activities of the Vessel

The vessel 1 has the functions of carrying several operations on underwater wells either at the first drilling or re-drilling for workover purposes.

These operations can be performed mainly either by means of the tower crane 14 or by means of the compensation unit 19 operating according to the compensation mode or by means of the tower crane 14 in co-operation with the compensation unit 19.

Further to the compensation function, the compensation unit 19 has the functions of displacing and raising items above the moon pool 11 when operated in the elevator mode and disconnected from the wellhead 5 (FIG. 1).

In FIG. 4, the support carrier 28 is connected to a tubular string R, whereas the blowout preventer 25 is lying on the plate 31 of the support carrier 28. Operations of connecting the tubular string R to the blowout preventer 25 are performed on the plate 31 by the operators. The transfer of the blowout preventer 25 from a rest position on the main deck 7 shown in FIG. 2 to the position on plate 31 shown in FIG. 4 includes the following steps:

- displacing the compensation unit 19 from the operating position to the rest position together with a tubular string R hanged to the support carrier 28;
- displacing the blowout preventer 25 along line 53 by means of the support carriage 22 up to cross line 51 (FIG. 2);
- displacing the support carriage 22 with the blowout preventer 25 along line 51 on the dolly 20;
- displacing the dolly 20 together with the carriage 22 and the blowout preventer 25 along the moon pool 11 up to arrange the blowout preventer 25 along axis A;
- raising the blowout preventer 25 by means of the tower crane 14 (FIG. 4);
- displacing back the dolly 20 together with carriage 22 in the rest position (FIG. 4);
- displacing the compensation unit 19 in the operating position along axis A together with the tubular string R and with plate 31 arranged below the suspended blowout preventer 25 (FIG. 4);
- lowering the blowout preventer 25 on plate 31 by means of the tower crane 14 (FIG. 4).

A similar succession of steps is undertaken for transferring the coil tubing frame 23 from the rest position shown in phantom in FIG. 2 to the operating position shown in FIG. 1. An intermediate position is shown in FIG. 5 where the coil tubing frame 23 is lying on the dolly 20.

During the transfer of the coil tubing frame 23, the panel 17 of the drill deck 9 is removed to let the coil tubing frame 23 extending over the drill deck 9 because of the considerable height of the coil tubing frame 23.

The Advantages

The main advantages of the present invention consist in limiting the hanging of heavy items above the main deck and, more generally, in improving the safety conditions aboard the vessel 1 in connection with multipurpose activities. Particularly relevant for these achievements are the dual mode operating compensation unit 19, the sliding arrangement of the compensation unit 19 along the main deck 7, the dolly 20, the rail assembly 21; the mutual arrangements of the tower crane 14, the compensation unit 19, and the dolly 20 that co-operate in coordinated manner to transfer heavy items.

However, the compensation unit 19 alone when mounted on the main deck 7 may achieve considerable improvements for the displacements of heavy items. In particular according to a variation of the best embodiment the plate 31 can be aligned to the main deck 7 or, better said, the dolly can be brought to a level at which the upper surface of the plate 31 is flush with the main surface 7A.

According to the present invention heavy and burdensome items are suspended from a relatively short time and only along axis A. There is no need of displacing the items in horizontal direction above the main deck while suspended and oscillations of the suspended items are small.

It is intended that many modifications can be done to the best embodiment of the present invention as described without departing form the scope of protection defined by the following claims.

The invention claimed is:

1. A vessel for operating on underwater wells, the vessel comprising:

a deck;

a moon pool extending through the deck;

a drill deck fixedly mounted to the deck, elevated above the moon pool, and having a hole; and a compensation unit slidably mounted on the deck for movement in a substantially horizontal direction with respect to the deck and the drill deck so as to arrange the compensation unit in a number of positions over the moon pool with respect to the deck and the drill deck, the compensation unit being above the moon pool and entirely between the deck and the drill deck, the compensation unit comprising:

a frame, a support carrier movable with respect to the frame in a substantially vertical direction and suitable to carry items, and a driving assembly connected to the support carrier, mounted to the frame such that the driving assembly moves with the frame as the compensation unit moves in the substantially horizontal direction, and configured to be selectively set to displace the support carrier with respect to the frame in a heave compensation mode and in an elevator mode.

2. The vessel as claimed in claim 1, wherein the support carrier comprises a support plate for carrying items.

3. The vessel as claimed in claim 2, wherein the support plate has a hole for suspending a tubular string to the support plate; said tubular string extending through the moon pool.

4. The vessel as claimed in claim 3, wherein the support plate has an outer edge and a slit running from the outer edge to the hole; said slit being sized to allow the tubular string to pass therethrough.

5. The vessel as claimed in claim 4, wherein the frame comprises four upright beams positioned, when viewed in cross-section along a horizontal plane, at vertexes of an imaginary rectangle, and a plurality of beams connecting the four upright beams along first, second, and third sides of the imaginary rectangle such that truss structures are formed along the first, second, and third sides of the imaginary rectangle and the fourth side of the rectangle is open; and wherein said slit extends from the hole towards said fourth side.

6. The vessel as claimed in claim 1, wherein the substantially horizontal direction is substantially parallel to the deck.

7. The vessel as claimed in claim 1, wherein the support carrier comprises a plate having a hole for suspending a tubular string and a slit for inserting the tubular string through the plate; said slit extending in said substantially horizontal direction.

8. The vessel as claimed in claim 1, wherein the driving assembly comprises:

at least a driving mechanism which connects the frame to the support carrier and includes a hydraulic linear actuator;

a compensation reservoir operating according to the principle of the constant load;

a hydraulic pump; and a hydraulic circuit for selectively connecting the hydraulic linear actuator to the compensation reservoir so as to operate the support carrier in the compensation mode, and to the hydraulic pump so as to operate the support carrier in the elevator mode.

9. The vessel as claimed in claim 1, further comprising:

a tower crane mounted on said drill deck; and a draw work connected to the tower crane to raise and lower a tubular string into the body of water through the moon pool and through the hole along an operating axis parallel to said substantially vertical direction.

10. The vessel as claimed in claim 9, wherein said frame is slidingly to a top surface of the deck and slidingly coupled to a bottom surface of the drill deck.

11. The vessel as claimed in claim 9, wherein the drill deck comprises a removable deck panel extending above the moon pool so as to let the item carried by the support carrier to protrude over the drill deck.

12. The vessel as claimed in claim 10; wherein said frame slidingly engages first tracks extending along the top surface of the deck and second tracks extending along the bottom surface of the drill deck.

13. The vessel as claimed in claim 1, wherein the drive assembly comprises:

linear actuators connected to the support carrier;

a compensation reservoir;

a hydraulic circuit connecting the linear actuators to the compensation reservoir; and a valve for isolating the hydraulic linear actuators from the compensation reservoir.

14. A vessel for operating on underwater wells, comprising:

a deck;

a moon pool extending through the deck;

a drill deck fixedly mounted to the deck, elevated above the moon pool and having a hole; and a compensation unit mounted on the deck above the moon pool and contained entirely between the deck and the drill deck, the compensation unit comprising:

a frame, a support carrier movable with respect to the frame in a direction substantially vertical and configured to carry items, and a driving assembly connected to the support carrier and mounted to the frame;

wherein the compensation unit is slidingly coupled to the deck to displace the support carrier along the deck above the moon pool with respect to the deck and the drill deck in a substantially horizontal direction;

wherein the frame, the support carrier, and the driving assembly are configured to move together as the compensation unit moves in the substantially horizontal direction with respect to the deck and the drill deck.

15. The vessel as claimed in claim 14, wherein the substantially horizontal direction is substantially parallel to the deck.

16. The vessel as claimed in claim 15, wherein the support carrier comprises a plate including a hole for suspending a tubular string, and a slit for laterally inserting the tubular string up to the hole; said slit being parallel to the substantially horizontal direction.

17. The vessel of claim 14, wherein the frame is slidingly coupled to a top surface of the deck and slidingly coupled to a bottom surface of the drill deck.

18. A working method of a vessel for operating on underwater wells, wherein the vessel comprises a deck; a moon pool extending through the deck; a drill deck fixedly mounted on the deck, elevated above the moon pool, and having a hole; and a compensation unit mounted on the deck above the moon pool and entirely between the deck and the drill deck, the compensation unit comprising a frame, a support carrier moveable with respect to the frame in a direction substantially vertical and configured to carry items, and a driving assembly that is connected to the support carrier and mounted to the frame; the method comprising the step of:

selectively setting the driving assembly to displace the support carrier with respect to the frame in said substantially vertically direction in an elevator mode; and sliding the compensation unit along the deck in a substantially horizontal direction so as to arrange the support carrier in a number of positions above the moon pool and with respect to the deck and the drill deck, wherein the frame, the support carrier, and the driving assembly move together as the compensation unit moves in the substantially horizontal direction.

19. The method as claimed in claim 18, further comprising the step of suspending a tubular string to the support carrier.

20. The method as claimed in claim 18, wherein the support carrier has a support plate having an outer edge, a hole, and a slit running from the hole to the outer edge; the method further comprising the step of coupling the tubular string to the support plate by laterally inserting the tubular string through said slit in the substantially horizontal direction.

21. The method as claimed in claim 19, further comprising the step of sliding the compensation unit on the first deck while the tubular string is suspended to the support carrier.

22. The method as claimed in claim 18 including the step of running a dolly along the moon pool; said dolly being slidingly coupled to the deck.

23. The method as claimed in claim 18, further comprising the step of transferring an item from a rest position on the deck to an operating position on the support carrier by means of a dolly arranged above the moon pool; a tower crane operating along a given axis above the moon pool, and said compensation unit.

24. The method as claimed in claim 23, wherein the item is a coil tubing frame, a blowout preventer, or a christmas tree.

25. The method as claimed in claim 23, further comprising the step of transferring said item from the deck to the dolly by means of a rail assembly extending along the deck and the dolly.

* * * * *